US006920860B2

(12) United States Patent
Gabriel et al.

(10) Patent No.: US 6,920,860 B2
(45) **Date of Patent: *Jul. 26, 2005**

(54) COOLING CHANNEL COVER FOR A ONE-PIECE PISTON OF AN INTERNAL COMBUSTION ENGINE

(75) Inventors: Dieter Gabriel, Highland, MI (US); Michael T. Lapp, Bloomfield, MI (US)

(73) Assignee: Mahle GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/679,588

(22) Filed: Oct. 6, 2003

(65) Prior Publication Data

US 2005/0072386 A1 Apr. 7, 2005

(51) Int. Cl.[7] ..... F02F 3/00
(52) U.S. Cl. ..... 123/193.6; 92/186; 29/888.04
(58) Field of Search ..... 123/193.6, 41.35, 123/183.6; 92/186, 159, 100, 190; 29/888.04, 888.045, 888.049

(56) References Cited

U.S. PATENT DOCUMENTS

| | | | | |
|---|---|---|---|---|
| 4,986,167 A | * | 1/1991 | Stratton et al. | 92/186 |
| 5,052,280 A | * | 10/1991 | Kopf et al. | 92/186 |
| 5,144,923 A | | 9/1992 | Leites et al. | |
| 5,261,363 A | | 11/1993 | Kemnitz | |
| 5,357,920 A | * | 10/1994 | Kemnitz et al. | 123/193.6 |
| 5,394,819 A | | 3/1995 | Aarnio | |
| 5,546,896 A | * | 8/1996 | Zaiser | 123/193.6 |
| 5,778,533 A | | 7/1998 | Kemnitz | |
| 5,778,846 A | * | 7/1998 | Mielke | 123/193.6 |
| 6,453,797 B1 | * | 9/2002 | Bauer | 92/186 |
| 6,659,062 B1 | * | 12/2003 | Issler | 123/193.6 |
| 6,722,263 B2 | * | 4/2004 | Keller et al. | 92/186 |

FOREIGN PATENT DOCUMENTS

| | | |
|---|---|---|
| DE | 252 638 | 12/1987 |
| DE | 41 34 530 | 5/1992 |
| DE | 40 39 751 | 6/1992 |
| DE | 42 08 037 | 3/1998 |
| EP | 0 561 871 | 11/1995 |
| EP | 0 799 373 | 1/1999 |

OTHER PUBLICATIONS

International Standard ISO 1043–1 dated 1997.

* cited by examiner

*Primary Examiner*—Marguerite McMahon
(74) *Attorney, Agent, or Firm*—Collard & Roe, P.C.

(57) ABSTRACT

A cooling channel cover for a one-piece piston of an internal combustion engine, the piston having a closed cooling channel that runs around inside the piston crown, at the level of the piston ring band, and a ring-shaped recess provided between the piston ring band and the piston shaft. The piston shaft is connected with the piston hubs suspended on the piston crown. In such a piston, an easy to assemble cooling channel cover is achieved by a one-piece plastic/spring steel ring that is U-shaped in cross-section, having a ring bottom and an outer shank around the circumference, molded onto the ring bottom and angled off radially to the outside, and an inner shank around the circumference, angled off radially to the inside. The plastic ring has a first radial division having a mouth width and a second radial division, opposite the first division, which does not separate the radially angled outer shank that runs around the circumference, to form a film hinge for radial deflection of a ring shank formed by the film hinge.

15 Claims, 2 Drawing Sheets

COOLING CHANNEL COVER FOR A ONE-PIECE PISTON OF AN INTERNAL COMBUSTION ENGINE

BACKGROUND OF THE INVENTION

1. Field of the Invention

The invention relates to a cooling channel cover for a one-piece piston of an internal combustion engine, the piston having a closed cooling channel that runs around inside the piston crown, at the level of the piston ring band, and a ring-shaped recess provided between the piston ring band and the piston shaft. The piston shaft is connected with the piston crown via hubs suspended on the piston crown.

2. The Prior Art

A multi-part cooled piston having a cooling channel arranged in the edge region of the piston head is known from German Publication No. DE 40 39 751 A1, which channel is covered with a sheet-metal ring essentially structured like a cup spring. This sheet-metal ring is structured in one piece and can be easily assembled with the piston only because the piston is structured in two parts. In this connection, it is necessary to assemble the sheet-metal ring with the upper piston part first, before the latter is connected with the lower piston part.

Furthermore, pistons are known from German Publication No. DD 252 638 A1 and German Publication No. DE 41 34 530 A1, in which a wall part that covers the cooling channel that is open to the bottom, and runs around the circumference in ring shape, is structured as an open sheet-metal ring, which rests in a groove against the inside circumference of the piston ring zone, and against the outside circumference of the combustion chamber wall, respectively, taking advantage of its plastic deformation according to the Seeger ring principle, i.e. biased in the radial direction.

Furthermore, a multi-part piston having a cooling channel is known from German Patent No. DE 42 08 037 C2, in which the cooling channel, which is open to the bottom, is covered by means of a biased cup spring, which is divided into at least two parts on its circumference, and rests freely on supports against axially opposite sides, radially on the inside and the outside.

Finally, one-piece cooling channel pistons having a cooling channel arranged in the edge region of the piston head are known from EP 0 561 871 B1 and EP 0 799 373 B1, which channel is also closed off with cover rings structured like cup springs, or cover rings structured like cup springs and provided with a collar.

A disadvantage of the aforementioned embodiments is that the cover ring or cup spring must be structured in two parts, in order to be able to be assembled. Furthermore, during assembly, each of the two semi-circular ring halves must be individually introduced into corresponding bearings on the piston crown, in the biased state.

SUMMARY OF THE INVENTION

It is therefore an object of the invention to provide a cooling channel cover for a one-piece piston of an internal combustion engine, which cover can be installed easily and quickly, whereby the piston weight is reduced as compared with the known state of the art.

This task is accomplished by a one-piece plastic/spring steel ring, U-shaped in cross-section, which has a ring bottom and an outer shank around the circumference that is molded onto the ring bottom and angled off radially to the outside, and an inner shank around the circumference that is angled off radially to the inside. A film hinge radially deflects the ring shank of the plastic ring formed by the hinge, in its positional plane. The ring has a first radial division having a mouth width and a second radial division, approximately opposite the first division, on the circumference, which does not separate the radially angled outer shank that runs around the circumference, to form the film hinge. The U-shaped ring is preferably made of a thermoplastic plastic such as polyphenylene sulfide (PPS) or a polyimide (PI) or a spring steel. In this manner, the cooling channel cover allows very simple and quick assembly on the piston, and a reduction in the piston weight by means of the construction.

The film hinge is preferably determined by a material thickness of the outer shank. The outer shank is preferably arranged on an outside circumference of the piston crown and is angled off radially to the outside, with reference to a crosswise piston axis, and the inner shank is preferably arranged on the inside circumference of the piston head and is angled off radially to the inside.

In a preferred embodiment, slits that extend close to the ring bottom are made in the outer and inner shanks. The slits are non-uniformly distributed over the circumference of the ring, in order to produce a plurality of shanks having different ridge lengths. The film hinge is preferably arranged in a region between the slits. The slits preferably have a width of 2 to 3 mm and the ridge lengths between the slits are 15 to 20 mm.

Preferably, the first radial division having the mouth width forms a cooling oil inlet or a cooling oil outlet for the cooling channel.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
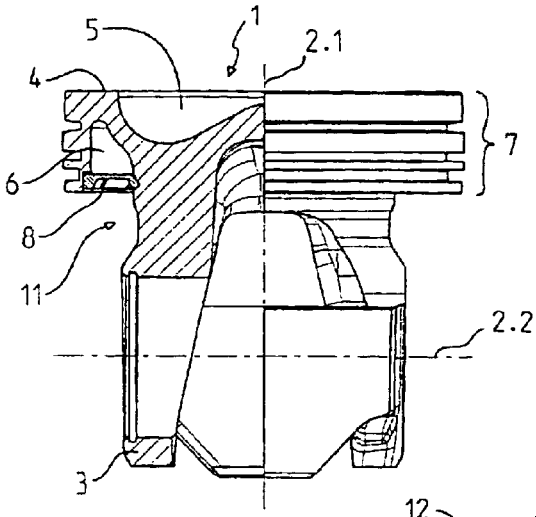
FIG. 1 shows a one-piece piston for an internal combustion engine, having a cooling channel, which channel is closed off by a U-shaped ring according to the invention, shown in a cross-sectional diagram that consists of two halves, which shows two longitudinal cross-sections of the piston, offset by 90°.
Figure 2:
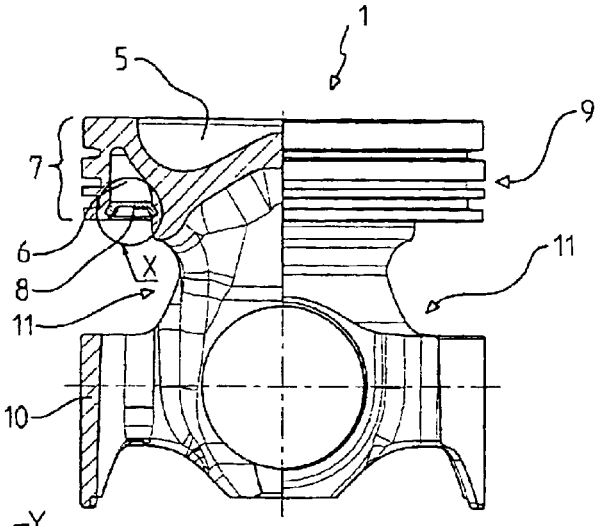
FIG. 2 shows a piston according to FIG. 1, rotated by 90°.

Referring now in detail to the drawings, FIG. 1 shows a one-piece piston 1 for an internal combustion engine, in a cross-sectional diagram that consists of two halves, the left half representing a cross-section of the piston 1 along a longitudinal axis 2 of the piston, and the right half representing a longitudinal axis of the piston 1 that is offset from the former by 90°.

Piston 1 is made of steel and has a piston crown 9 having a piston ring band 7 and a piston head 4 having a combustion space depression 5, whereby the piston shaft 10 is connected with the piston hubs 3 suspended on the piston crown. At the level of piston ring band 7, a closed cooling channel 6 that runs around the circumference in ring shape is arranged in piston crown 9, the radial outer delimitation and radial inner delimitation of which channel are determined by the ring wall molded onto the piston head 4 and by the piston crown region on which piston hubs 3 are suspended. The inside of the cooling channel 6 has a recess 14.2 on the ring wall side and a recess 14.1 on the piston crown side, the wall regions of which result in a conically narrowed shape in the axial direction, towards piston head 4. The incline, in each instance, is characterized by the angle between the axial piston axis 2.1 and the slant of the recess wall, which is approximately 30°. The recesses 14.1 and 14.2 are delimited by a step 15.1 and 15.2, in each instance, which also result in a conically narrowed shape in the direction towards piston shaft 10, and whose aforementioned defined angle has a value of approximately 20 to 30°.

A ring-shaped recess 11 is provided between piston ring band 7 and piston shaft 1C, by means of which assembly for closing off the cooling channel 6 by means of a one-piece plastic/spring steel ring 8, U-shaped in cross-section, takes place.

According to the invention, a thermoplastic polymer plastic, such as polyphenylene sulfide (PPS), Ryton R4® or high-temperature polyimide (PI), such as VESPEL® from DuPont or AURUM® from Mitsui Chemicals Inc., is preferably used for this purpose. The abbreviations correspond to the international standard ISO 1043-1 dated 1997. Such plastics are characterized by their resistance to high temperatures, i.e. heat, of 200° C. to over 400° C. in long-term operation. In addition, the plastic can also be fiber-reinforced. The spring steel can be a standard carbon spring steel like CK 75. Tempering is optional.

Figure 4:
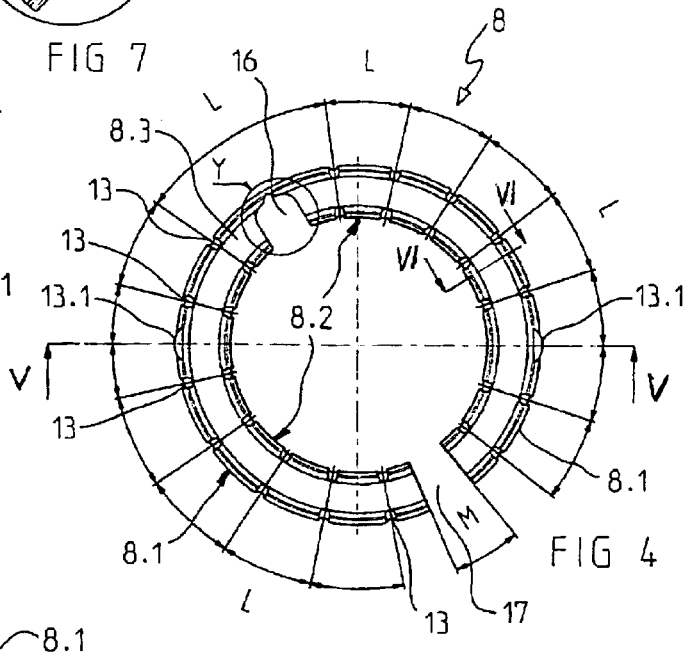
FIG. 4 shows a top view of the U-shaped plastic ring.

According to FIG. 4, U-shaped plastic ring 8 has a radial outer shank 8.1 angled away from its ring bottom 8.3, and a radial inner shank 8.2 angled away from ring bottom 8.3, the shanks being are divided by slits 13 non-uniformly distributed over the circumference, in order to simplify carrying out the assembly, so that shank segments L of different lengths are formed. The slits are made down close to the bottom 8.3 of plastic ring 8 and have a slightly V-shaped or U-shaped form and a slit width of 2 to 3 mm. The aforementioned radial slitting takes place distributed over the circumference of the ring, preferably in an angle range between 15 and 25°.

Figure 6:
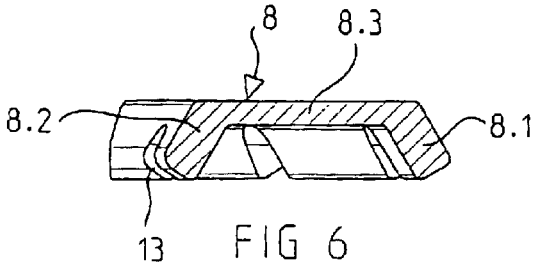
FIG. 6 shows a cross-section along the line VI—VI of the U-shaped ring according to FIG. 4.
Figure 5:
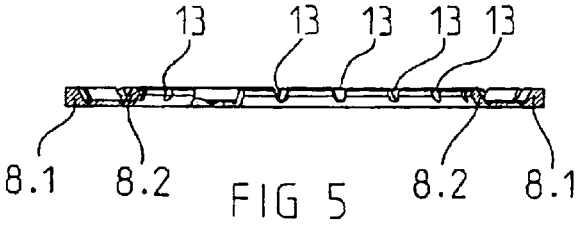
FIG. 5 a cross-section along the line V—V of the U-shaped ring according to FIG. 4.

As shown in the cross-sectional diagram according to FIG. 6, outer shank 8.1 is arranged on the outside circumference of the ring bottom 8.3, and angled off radially to the outside with reference to crosswise axis 2.2 of the piston, from the ring bottom 8.3, whereby inner shank 8.2 is angled off radially towards the inside, and is arranged on the inside circumference of the piston bottom 8.3.

As is evident from FIG. 4, U-shaped plastic ring 8 is radially divided in such a way that opening 17 with a mouth width M is formed. At 180° opposite to this there is a U-shaped opening 16 having approximately the same width, which extends over the radial center of ring bottom 8.3. Both openings 16 and 17 serve as the oil inlet and oil outlet, respectively, in the assembled state of the ring 8, to supply cooling channel 6 with oil.

Figure 7:
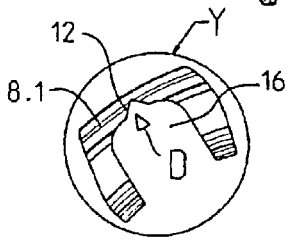
FIG. 7 shows a partial detail of the piston according to Detail Y from FIG. 4.
Figure 3:
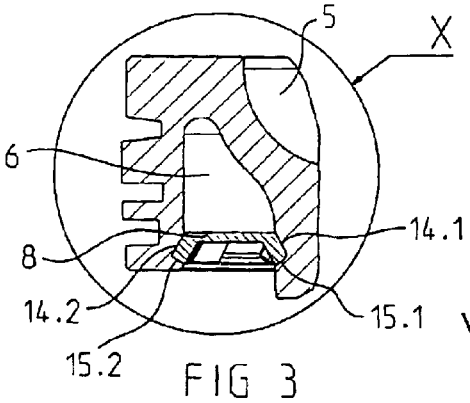
FIG. 3 shows a partial detail of the piston according to Detail X from FIG. 2.
Figure 8:
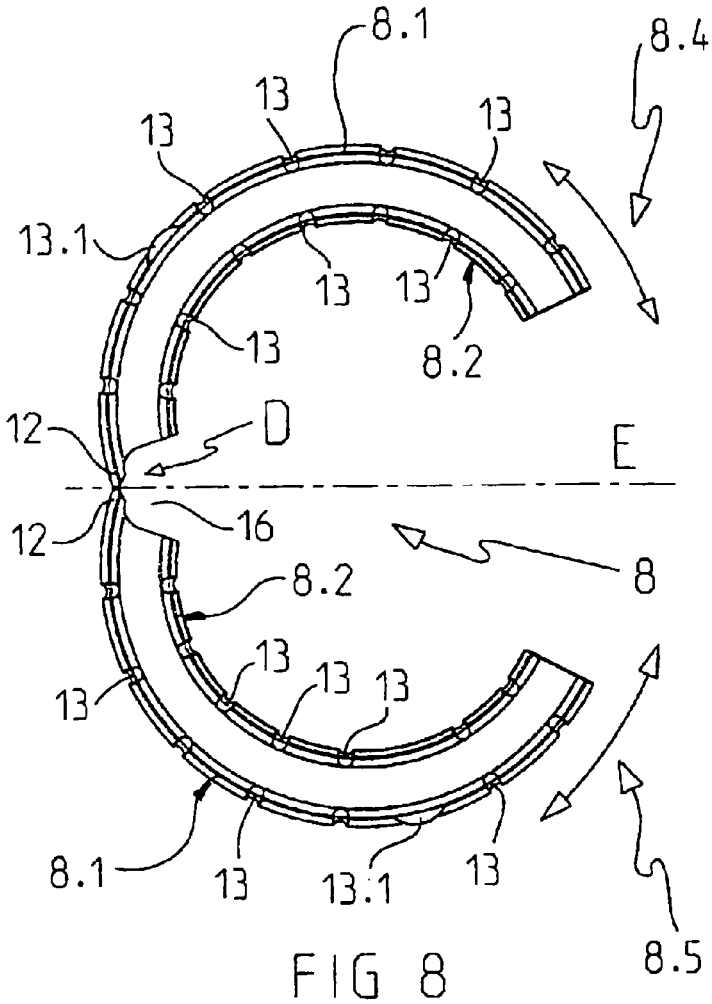
FIG. 8 shows a top view of the U-shaped ring, in the state in which it is opened by means of the film hinge according to the invention.

According to FIG. 4 and to the enlarged detail view according to FIG. 7, a so-called film hinge 12 is arranged on the radially outer and center end of opening 16, which hinge is essentially formed by a second radial cut D into the piston head up to the outer shank 8.1, so that radial deflection of the ring shanks 8.4 and 8.5 resulting from the film hinge, in the positional plane E of the plastic ring, as shown by arrows in FIG. 8, is made possible by way of the material thickness of outer shank 8.1. In this connection, the size of the deflection of the ring shanks is determined by the mechanical strength of the plastic used for ring 8, and can certainly take place all the way to contact of the outside radii of the ring.

Figure 9:
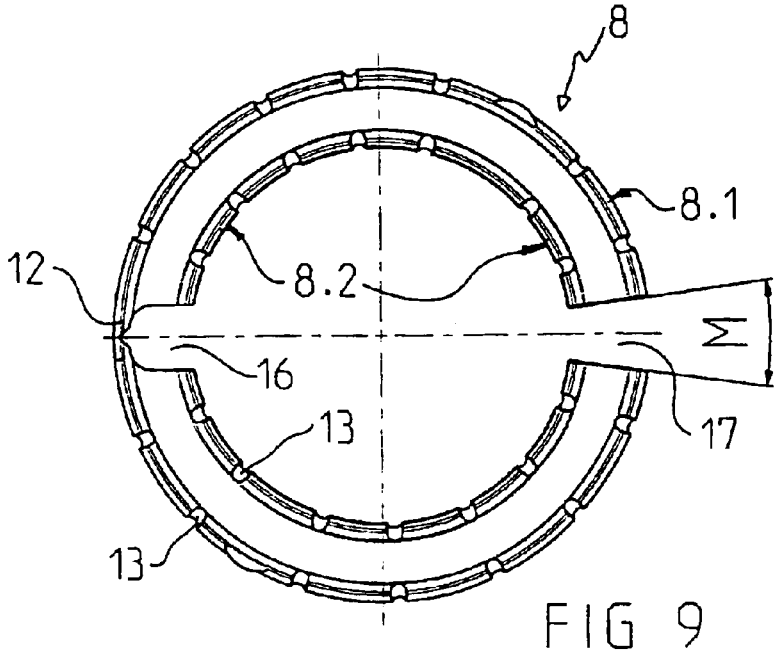
FIG. 9 shows a top view of the U-shaped ring, in the state in which it is closed by means of the film hinge according to the invention.

In accordance with another exemplary embodiment of the invention, not shown, such a film hinge 12 can also be arranged on the radially inner shank 8.1 of the U-shaped ring 8, whereby in this embodiment, the opening 16 is directed not radially inward, as shown in FIGS. 8 and 9, but rather radially outward. However, this greatly limits the deflection of the two ring shanks 8.4 and 8.5, since this is determined by the width of the opening 16.

Assembly of the ring 8 can take place in a simple manner, in that it is bent up, using the film hinge 12, in such a way that it is introduced into the recess 11, and pushed over the hub region suspended on the piston crown. In this pre-assembled state, the ring is oriented towards the piston head with its ring bottom 8.3. In order to close off the cooling channel 6, the ring 8 is subsequently pressed over steps 15.1 and 15.2, so that its outer and inner shanks 8.1 and 8.2 come to rest on recesses 14.1 and 14.2, whereby the faces of the shanks are supported on the steps. The radial deflection of shanks 8.1 and 8.2 is guaranteed by the elasticity of the plastic ring. One or two projections 13.1 that are arranged on the circumference, projecting on the circumference, opposite the outer shank 8.1, and engage in one or two recesses in the cooling channel, not shown, serve to prevent the U-shaped ring from rotating out of place.

Accordingly, while only a few embodiments of the present invention have been shown and described, it is obvious that many changes and modifications may be made thereunto without departing from the spirit and scope of the invention.

REFERENCE SYMBOL LIST

1 piston
2.1 longitudinal piston axis
2.2 crosswise piston axis
3 piston hubs
4 piston head
5 combustion space depression
6 cooling channel.
7 piston ring band
8 U-shaped ring
8.1 radially outer shank
8.2 radially inner shank
8.3 ring bottom
9 piston crown
10 shaft
11 ring-shaped recess
12 film hinge
13 slits

13.1 projections
14.1/14.2 circumferential recess
15.1/15.2 steps
16 cooling oil inlet
17 cooling oil outlet
D second radial division
E positional plane
L ridge length
M mouth width

What is claimed is:

1. A cooling channel cover for a one-piece piston of an internal combustion engine, the piston having a closed cooling channel that runs around inside a piston crown, at a level of a piston ring band, and a ring-shaped recess provided between the piston ring band and a piston shaft, wherein the piston shaft is connected with the piston hubs suspended on the piston crown, the cooling channel cover comprising a one-piece plastic ring having the following characteristics:

a U-shaped cross-section;

a ring bottom;

an outer shank around a circumference of the ring and being molded onto the ring bottom and angled off radially to the outside;

an inner shank around the circumference of the ring and being angled off radially to the inside;

a first radial division having a mouth width; and a film hinge for radial deflection of the outer shank of the plastic ring, the film hinge being formed by a second radial division, opposite the first division, on the circumference, wherein the second radial division does not separate the outer shank that runs around the circumference, to form the film hinge.

2. The cooling channel cover according to claim 1, wherein the film hinge is determined by a material thickness of the outer shank.

3. The cooling channel cover according to claim 1, wherein slits that extend close to the ring bottom are made in the outer and inner shanks, said slits being non-uniformly distributed over the circumference of the ring, in order to produce a plurality of shanks having different ridge lengths.

4. The cooling channel cover according to claim 3, wherein the film hinge is arranged in a region between the slits.

5. The cooling channel cover according to claim 3, wherein the slits have a width of 2 to 3 mm and the ridge lengths between the slits are 15 to 20 mm.

6. The cooling channel cover according to claim 1, wherein the first radial division having the mouth width forms a cooling oil inlet or a cooling oil outlet for the cooling channel.

7. The cooling channel cover according to claim 1, wherein the U-shaped ring is made of polyphenylene sulfide (PPS) or a polyimide (PI).

8. A one-piece piston of an internal combustion engine, comprising:

a piston crown:

a closed cooling channel that runs around inside the piston crown, at a level of a piston ring band;

a piston shaft connected to the piston crown via piston hubs suspended on the piston crown;

a ring-shaped recess provided between the piston ring band and the piston shaft; and a cooling channel cover comprising a one-piece plastic ring having the following characteristics:

a U-shaped cross-section;

a ring bottom;

an outer shank around a circumference of the ring and being molded onto a ring bottom and angled off radially to the outside;

an inner shank around the circumference of the ring and being angled off radially to the inside;

a first radial division having a mouth width; and a film hinge for radial deflection of the outer shank of the plastic ring, the film hinge being formed by a second radial division, opposite the first division, on the circumference, wherein the second radial division does not separate the outer shank that runs around the circumference, to form the film hinge.

9. The cooling channel cover according to claim 8, wherein the film hinge is determined by a material thickness of the outer shank.

10. The cooling channel cover according to claim 8, wherein the outer shank is arranged on an outside circumference of the piston crown and is angled off radially to the outside, with reference to a crosswise piston axis, and wherein the inner shank is arranged on an inside circumference of the piston head and is angled off radially to the inside.

11. The cooling channel cover according to claim 10, wherein slits that extend close to the ring bottom are made in the outer and inner shanks, said slits being non-uniformly distributed over the circumference of the ring, in order to produce a plurality of shanks having different ridge lengths.

12. The cooling channel cover according to claim 11, wherein the film hinge is arranged in a region between the slits.

13. The cooling channel cover according to claim 11, wherein the slits have a width of 2 to 3 mm and the ridge lengths between the slits are 15 to 20 mm.

14. The cooling channel cover according to claim 8, wherein the first radial division having the mouth width forms a cooling oil inlet or a cooling oil outlet for the cooling channel.

15. The cooling channel cover according to claim 8, wherein the U-shaped ring is made of polyphenylene sulfide (PPS) or a polyimide (PI) or carbon spring steel.

* * * * *